US005711464A

United States Patent [19]

Huang

[11] Patent Number: 5,711,464

[45] Date of Patent: Jan. 27, 1998

[54] LENGTH-ADJUSTABLE CLOTHES HANGER

[76] Inventor: Raymond Huang, No. 493, Ta-Yu Rd., Tao-Yuan City, Taiwan

[21] Appl. No.: 731,308

[22] Filed: Oct. 15, 1996

[51] Int. Cl.[6] ..... A47G 25/40; A47G 25/14

[52] U.S. Cl. ..... 223/94; 223/89; 223/85

[58] Field of Search ..... 223/89, 94, 85; D6/315, 318

[56] References Cited

U.S. PATENT DOCUMENTS

| | | | |
|---|---|---|---|
| 2,421,433 | 6/1947 | Poole | 223/89 |
| 2,673,668 | 3/1954 | Riddell | 223/89 |
| 2,679,958 | 6/1954 | Massa et al. | 223/89 |
| 2,796,206 | 6/1957 | Schwartz | 223/89 |
| 3,151,788 | 10/1964 | Wingate | 223/94 |

FOREIGN PATENT DOCUMENTS

| | | | |
|---|---|---|---|
| 167148 | 11/1950 | Austria | 223/89 |

*Primary Examiner*—Bibhu Mohanty
*Attorney, Agent, or Firm*—Harness, Dickey & Pierce, P.L.C.

[57] ABSTRACT

A length-adjustable clothes hanger includes a flexible arm has an elongated restraining member. The flexible arm has a plurality of first engaging members which are formed adjacent to each of the end portions of the flexible arm, and a hook which is connected to the intermediate portion of the flexible arm. The elongated restraining member has two second engaging members. Each of the second engaging members is connected to one of the first engaging members adjacent to a respective one of the end portions of the flexible arm.

10 Claims, 3 Drawing Sheets

LENGTH-ADJUSTABLE CLOTHES HANGER

BACKGROUND OF THE INVENTION

1. Field of the Invention

This invention relates to a clothes hanger, more particularly to a length-adjustable clothes hanger which has a simple and durable construction.

2. Description of the Related Art

Referring to FIG. 1, a conventional length-adjustable clothes hanger is shown to comprise an arm 1 and two opposed ends portions which are formed with a plurality of spaced annular grooves 2. Two spring clamps 3 with teeth 4 engage detachably and respectively the annular grooves 2 in the end portions of the arm 1. Therefore, the length of the hanger can be adjusted by moving the spring clamps 3 away or toward the end portions of the arm 1 and engaging the same. However, the clamping force of the spring clamps 3 is liable to fail due to fatigue of the springs of the spring clamps 3 after the spring clamps 3 have been in use for a period of time. In addition, the precision requirement for manufacturing the annular grooves 4 and the spring clamps 3 is high, thereby increasing the difficulty in manufacturing the conventional length-adjustable clothes hanger.

SUMMARY OF THE INVENTION

It is therefore a main object of the present invention to provide a length-adjustable clothes hanger which is easy to manufacture and which is more durable than the conventional clothes hanger.

According to the present invention, the length-adjustable clothes hanger comprises a flexible arm having a plurality of first engaging members which are formed adjacent to each of the end portions of the flexible arm, and a hook which is connected to the intermediate portion of the flexible arm. An elongated restraining member has two second engaging members. Each of the second engaging members is connected to one of the first engaging members adjacent to a respective one of the end portions of the flexible arm.

BRIEF DESCRIPTION OF THE DRAWINGS

Other features and advantages of this invention will become apparent in the following detailed description of the preferred embodiments of this invention with reference to the accompanying drawings, in which.

DETAILED DESCRIPTION OF THE PREFERRED EMBODIMENTS

Figure 1:
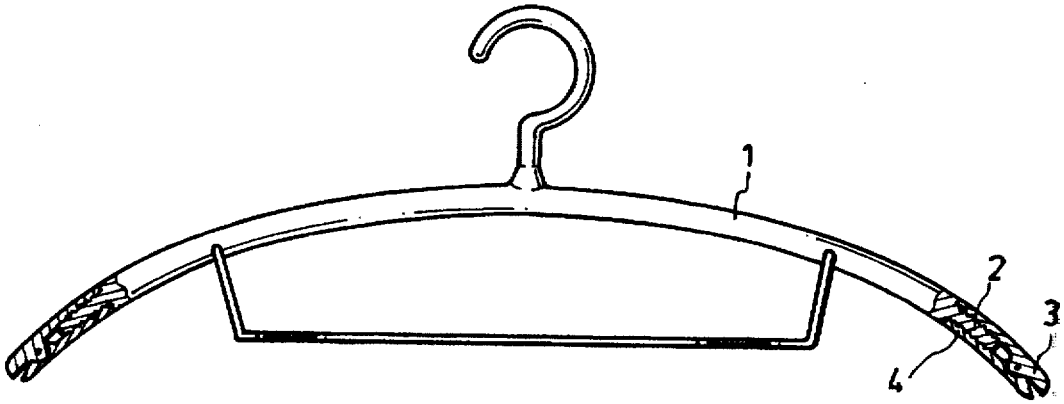
FIG.1 PRIOR ART
FIG. 1 is a partially sectional view of a conventional length-adjustable clothes hanger.
Figure 2:
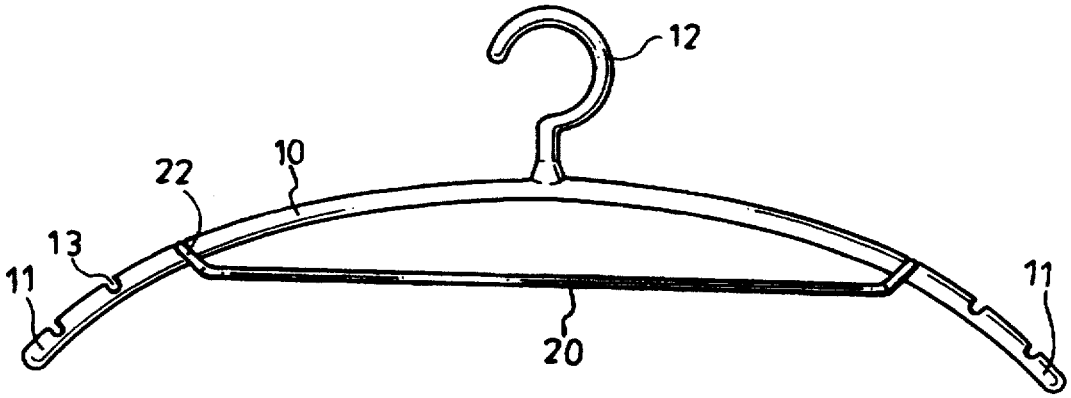
FIG. 2 is a plan view of a preferred embodiment of a length-adjustable clothes hanger according to the present invention.

Referring to FIG. 2, a preferred embodiment of a length-adjustable clothes hanger according to the present invention is shown to comprise a flexible arm 10 and an elongated restraining member 20.

The flexible arm 10 has a plurality of first engaging members 13 which are formed adjacent to each of the end portions 11 of the flexible arm 10. A hook 12 is formed integrally with the intermediate portion of the flexible arm 10. The flexible arm 10 is preferably made of an elastic material, such as acrylonitrile-butadiene-styrene resin.

The elongated restraining member 20 has two second engaging members 22. Each of the second engaging members 22 engages releasably one of the first engaging members 13 adjacent to a respective one of the end portions 11 of the flexible arm 20. The restraining member 20 is made of a plastic material or a metal material or is formed as a rope member.

Figure 3:
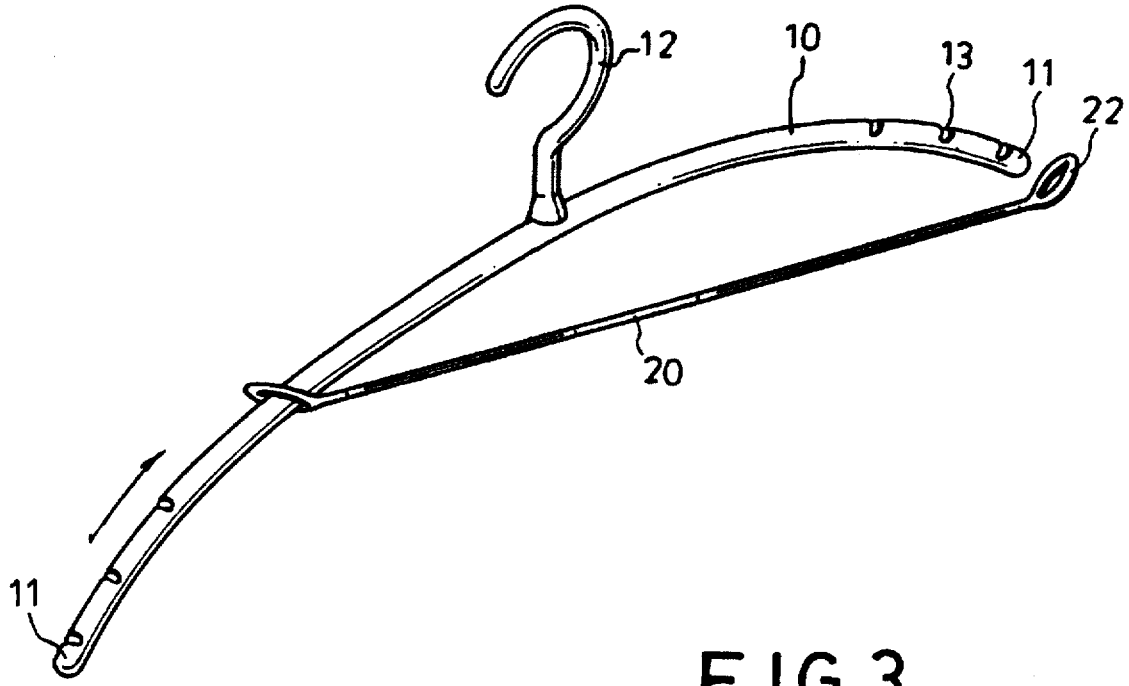
FIG. 3 is a schematic view illustrating how a restraining member is mounted to a flexible arm of the length-adjustable clothes hanger according to the present invention.
Figure 6:
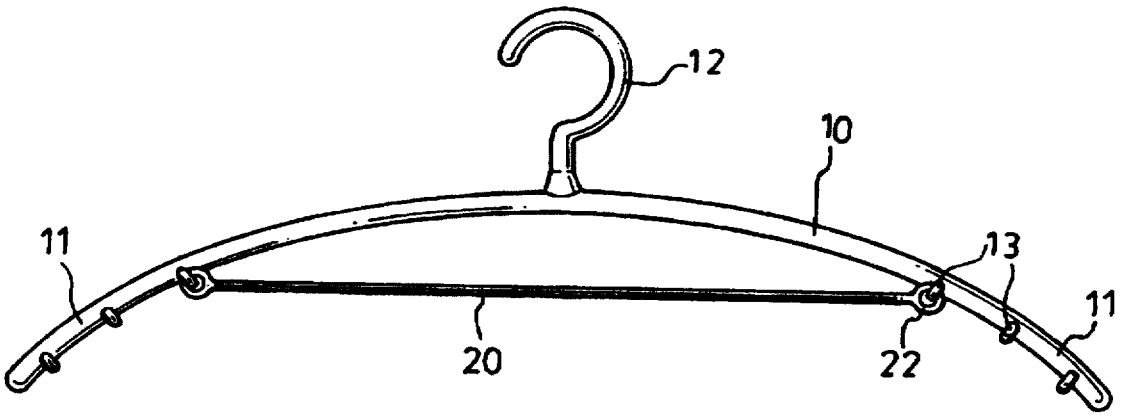
FIG. 6 is a plan view of a second preferred embodiment of a length-adjustable clothes hanger according to the present invention.

In the preferred embodiment, each of the first engaging members 13 is formed as a notch and each of the second engaging members 22 is formed as a ring, as best illustrated in FIG. 3. Alternatively, each of the first engaging members 13 may be formed as a projection, as best illustrated in FIG. 6.

In use, one of the end portions 11 of the flexible arm 10 passes through one of the second engaging members 22. The other end portion 11 then passes through the other second engaging member 22 in order to permit each of the second engaging members 22 to engage the first engaging member 13 on a respective one of the end portions 11 of the flexible arm 10, as best illustrated in FIGS. 2 and 3.

Figure 4:
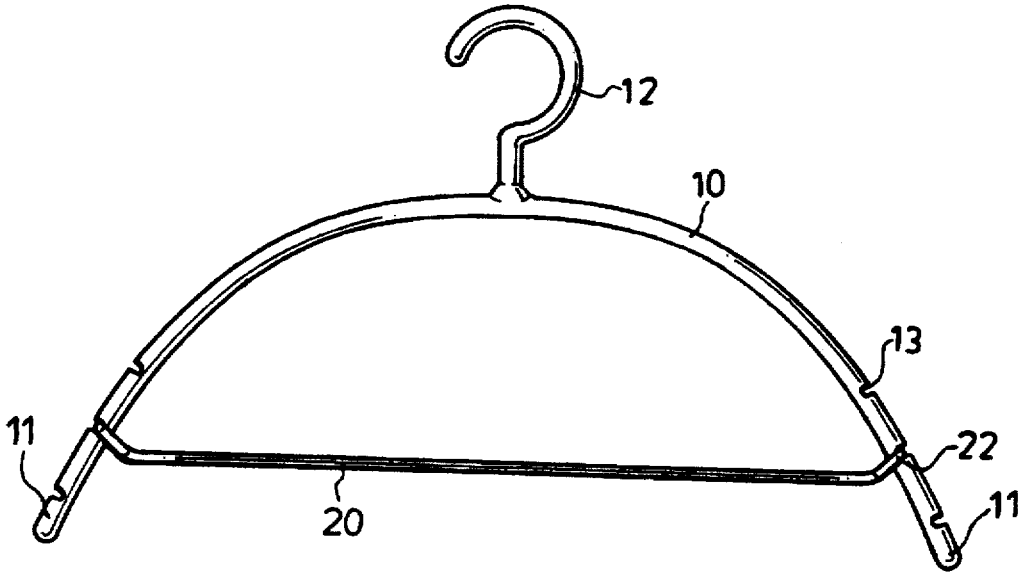
FIG. 4 is a schematic view illustrating the restraining member when engaging the flexible arm of the length-adjustable clothes hanger in a first operative position according to the present invention.
Figure 5:
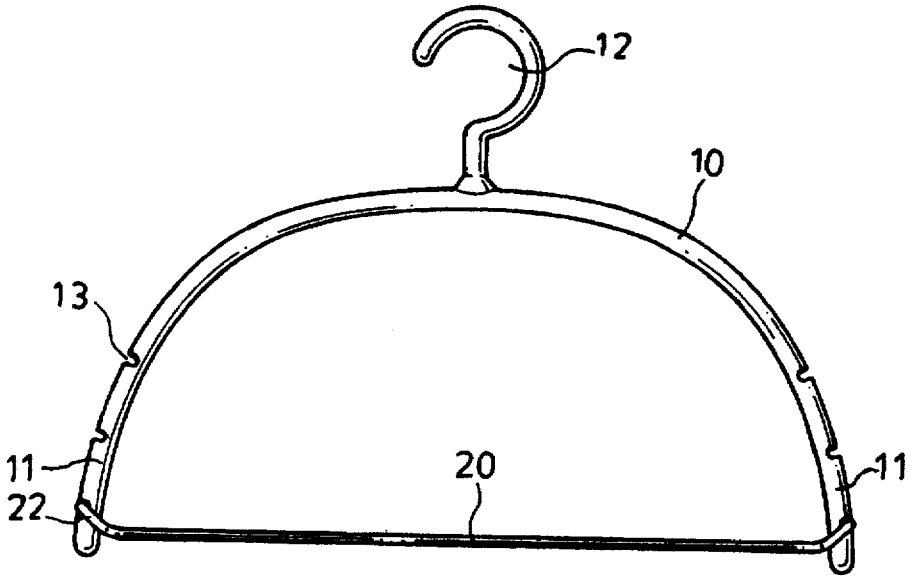
FIG. 5 is a schematic view illustrating the restraining member when engaging the flexible arm of the length-adjustable clothes hanger in a second operative position according to the present invention.

The length of clothes hanger is adjustable by means of engaging the second engaging members 22 with the first engaging members 13 which are spaced from the hook 12 by different distances. For example, when clothing of a larger size is to be hung, the second engaging members 22 may engage the first engaging members 13 which are close to the hook 12, as best illustrated in FIG. 2. When clothing of a smaller size is to be hung, the second engaging members 22 may engage the first engaging members 13 which are distal from the hook 12 in order to move the end portions 11 toward one another, thereby decreasing the length of the clothes hanger, as best illustrated in FIGS. 4 and 5.

It is noted that the length-adjustable clothes hanger of the present invention has a simple structure and is easy to manufacture. The first and second engaging members 13, 22 will not suffer from fatigue after being used for a period of time. Therefore, the length-adjustable clothes hanger of the present invention is more durable than the conventional length-adjustable clothes hanger.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangement.

I claim:

1. A length-adjustable clothes hanger comprising:

a flexible arm having opposite end portions and a plurality of first engaging members which are formed adjacent to each of said end portions;

a hook connected to an intermediate portion of said flexible arm; and an elongated restraining member having two ends, each of said ends having a second engaging member, respective ones of said second engaging members being connectable to varying ones of said plurality of first engaging members formed adjacent said end portions wherein the distance between said end portions may be varied by flexure of the arm with the engaging members.

2. The length-adjustable clothes hanger as claimed in claim 1, wherein each of said first engaging members is a notch, and said second engaging member of each of said ends of said restraining member is a ring.

3. The length-adjustable clothes hanger as claimed in claim 1, wherein each of said first engaging members is a projection, and said second engaging member of each of said ends of said restraining member is a ring.

4. The length-adjustable clothes hanger as claimed in claim 1 wherein each of said plurality of first engaging members are spaced at a different distance from respective of said end portion.

5. The length-adjustable clothes hanger as claimed in claim 1 wherein said elongated restraining member is of a substantially constant predetermined length.

6. The length-adjustable clothes hanger as claimed in claim 1 wherein said plurality of first engaging members are positioned at increasing distances from respective said opposite end portions of said flexible arm.

7. The length-adjustable clothes hanger as claimed in claim 6 wherein when said elongated restraining member is connected to first ones of said plurality of first engaging members, said end portions are separated by a first predetermined distance and when said elongated restraining member is connected to at least a second one of said plurality of first engaging members said end portions are separated by a second predetermined distance less than said first predetermined distance, said at least a second one being positioned closer to said respective end portion than said first one of said plurality of first engaging members.

8. A length adjustable clothes hanger comprising:

a flexible arm having first and second oppositely extending arm portions;

a hook connected to an intermediate portion of said flexible arm;

a plurality of first engaging members positioned in spaced relationship along the length of said first arm portion;

at least one second engaging member positioned on said second arm portion;

an elongated restraining member having a first end provided with a third engaging member and a second opposite end provided with a fourth engaging member, said third engaging member being connectable to said second engaging member and said fourth engaging member being connectable to respective ones of said plurality of first engaging members wherein said first and second arm portions are flexed about said intermediate portion to thereby adjust the length of said clothes hanger.

9. The length-adjustable clothes hanger as claimed in claim 8 wherein said elongated restraining member has a length which remains substantially constant.

10. The length-adjustable clothes hanger as claimed in claim 8 wherein the distance between the opposite ends of said first and second arm portions decreases as said fourth engaging member is moved from a first respective one of said first engaging members to a second respective one of said first engaging members, said second respective one of said first engaging members being positioned closer to said end of said first arm portion.

* * * * *